US011123597B2

(12) United States Patent
Gigerl

(10) Patent No.: US 11,123,597 B2
(45) Date of Patent: Sep. 21, 2021

(54) INERTIA TRAINING BOX WITH HORIZONTAL INERTIA WHEEL

(71) Applicant: Alexander Gigerl, Graz (AT)

(72) Inventor: Alexander Gigerl, Graz (AT)

( * ) Notice: Subject to any disclaimer, the term of this patent is extended or adjusted under 35 U.S.C. 154(b) by 290 days.

(21) Appl. No.: 16/385,068

(22) Filed: Apr. 16, 2019

(65) Prior Publication Data

US 2020/0330814 A1 Oct. 22, 2020

(51) Int. Cl.
*A63B 21/00* (2006.01)
*A63B 21/22* (2006.01)
*A63B 21/04* (2006.01)

(52) U.S. Cl.
CPC ..... *A63B 21/225* (2013.01); *A63B 21/0442* (2013.01); *A63B 21/153* (2013.01)

(58) Field of Classification Search
CPC ..... A63B 21/227
See application file for complete search history.

(56) References Cited

U.S. PATENT DOCUMENTS 3,841,627 A * 10/1974 Vetter ..... A63B 21/227 482/110
2005/0037902 A1* 2/2005 Charnitski ..... A63B 21/153 482/110
2014/0228181 A1* 8/2014 Powell ..... A63B 21/00069 482/115
2017/0216655 A1* 8/2017 Chang ..... A63B 21/15
2019/0350408 A1* 11/2019 Budd ..... A47J 37/07

FOREIGN PATENT DOCUMENTS

WO WO-2020084186 A1 * 4/2020

OTHER PUBLICATIONS

YouTube video titled "Exxentric kBox 4 Flywheel Training Review!" by Garage Gym Reviews published Dec. 28, 2017 and available at https://www.youtube.com/watch?v=B4BsGRKZBUU.*
YouTube video titled "VersaPulley—Training Reactive Strength" by VersaClimber published Dec. 3, 2014 and available at https://www.youtube.com/watch?v=HJzUgDj26es.*

* cited by examiner

*Primary Examiner* — Blake A Tankersley

(57) ABSTRACT

A space saving and production cost saving inertia wheel training device is disclosed. In preferred embodiments the present invention comprises: a box where one or more inertia wheels are mounted horizontally; a pull belt which connects the inertia wheel with the user. The user stands with both feet on the box and can attach various accessories to the pull belt, like bars, harnesses, hip belt etc. to connect the pull belt to his body depending on the type of exercise the user wants to perform. The user adjusts the length of the belt to his body size. Then the user accelerates the inertia wheel. At the end of each movement of the user the flywheel needs to be decelerated or accelerated to allow the user to change the direction of his movement. The inertia of the wheel creates a braking force at deceleration and acceleration which leads to a training effect of the user's muscles.

7 Claims, 6 Drawing Sheets

FIG 1. depicts a perspective view of an example of an inertia training box with horizontal inertia wheel according to various embodiments of the present invention.
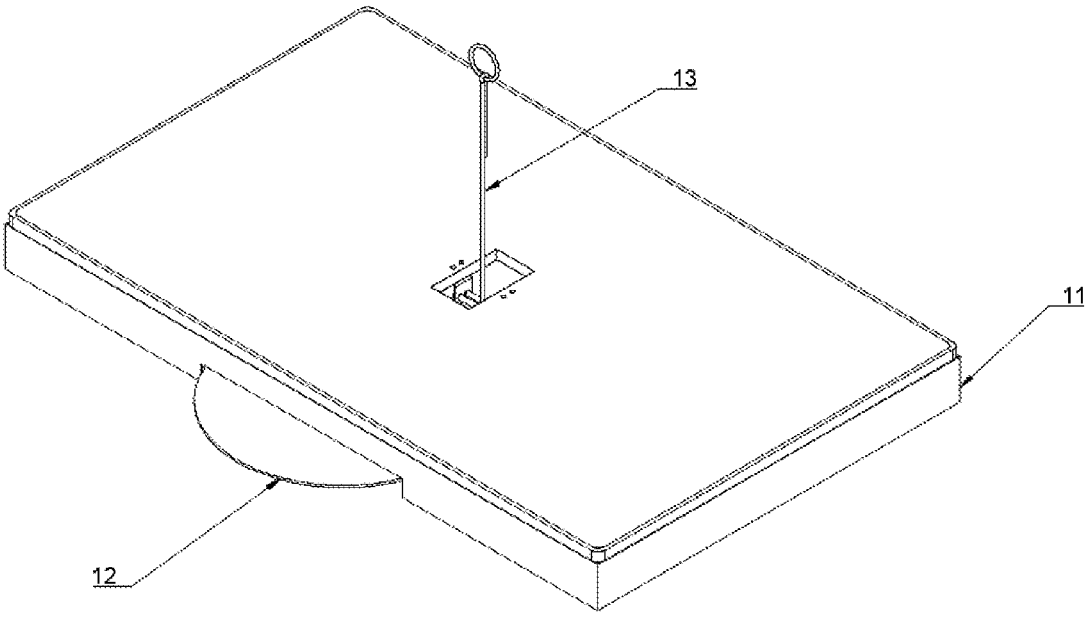

FIG 2. shows a front view of an example of an inertia training box with horizontal inertia wheel according to various embodiments of the present invention.
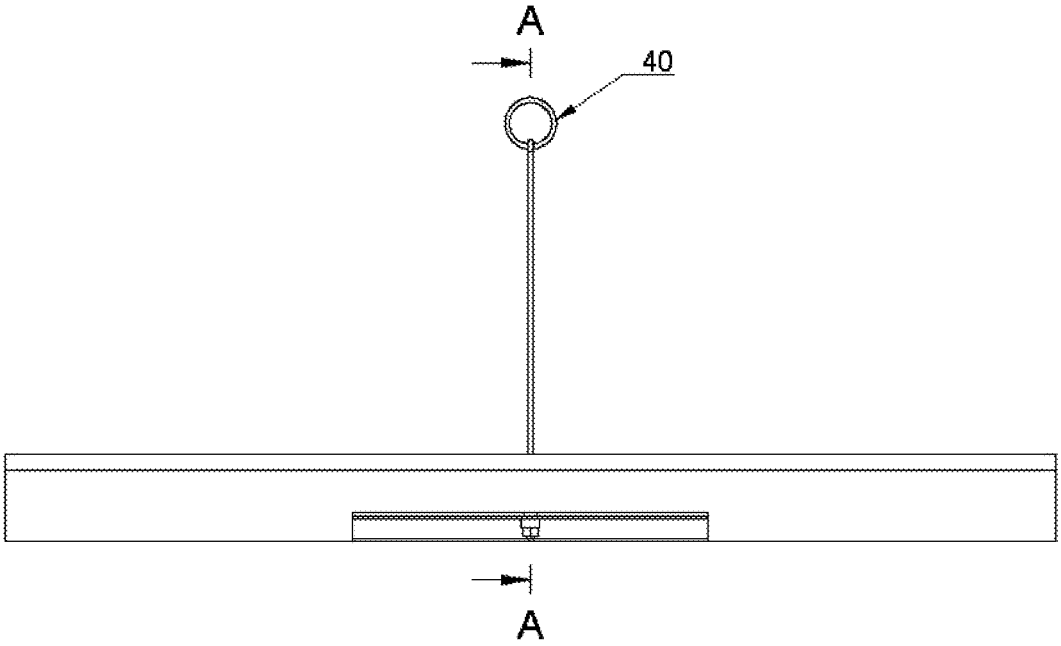

FIG 3. illustrates a sectional, through line A-A shown in FIG. 2, side elevation view of an example of an inertia training box with horizontal inertia wheel according to various embodiments of the present invention.
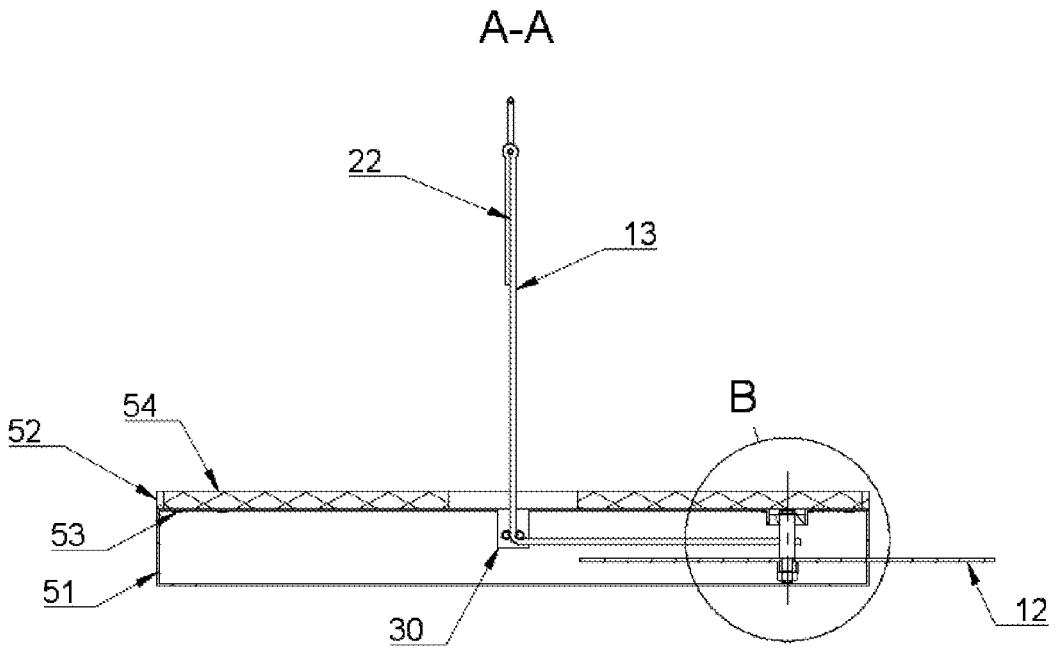

FIG 4. depicts a detailed view B as marked in FIG. 3, side elevation view of an example of an inertia training box with horizontal inertia wheel according to various embodiments of the present invention.
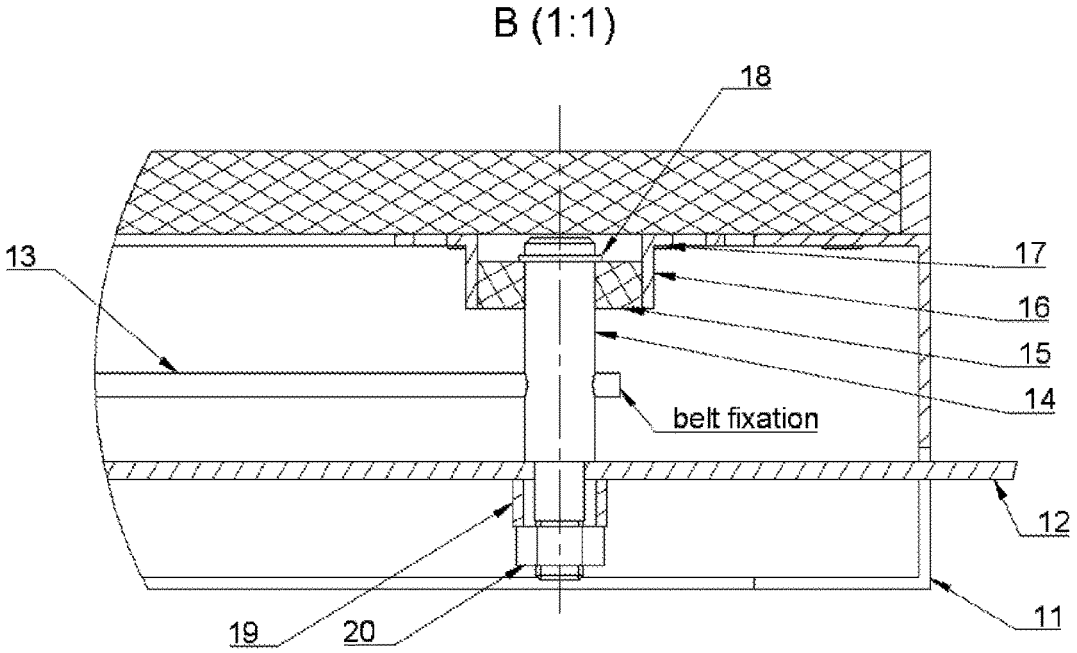

FIG 5. illustrates a bottom view of an example of an inertia training box with horizontal inertia wheel according to various embodiments of the present invention.
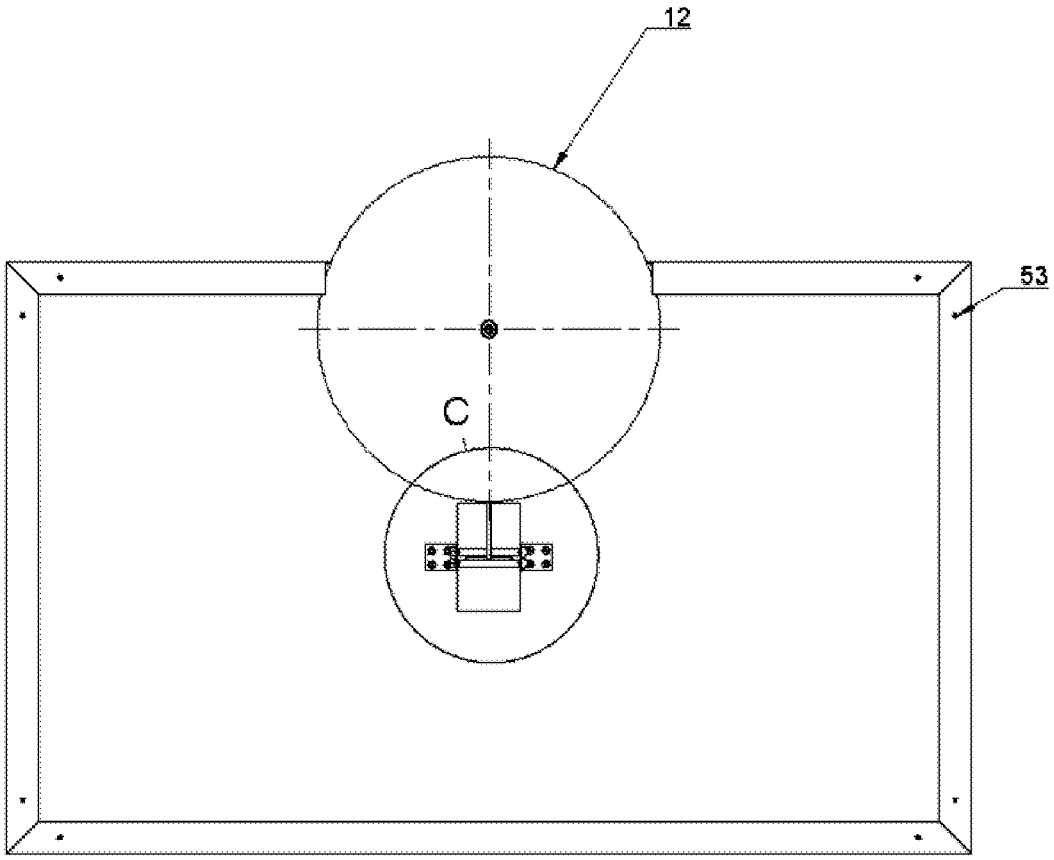

FIG 6. illustrates a detailed view C as marked in FIG. 5, bottom elevation view of an example of an inertia training box with horizontal inertia wheel according to various embodiments of the present invention.
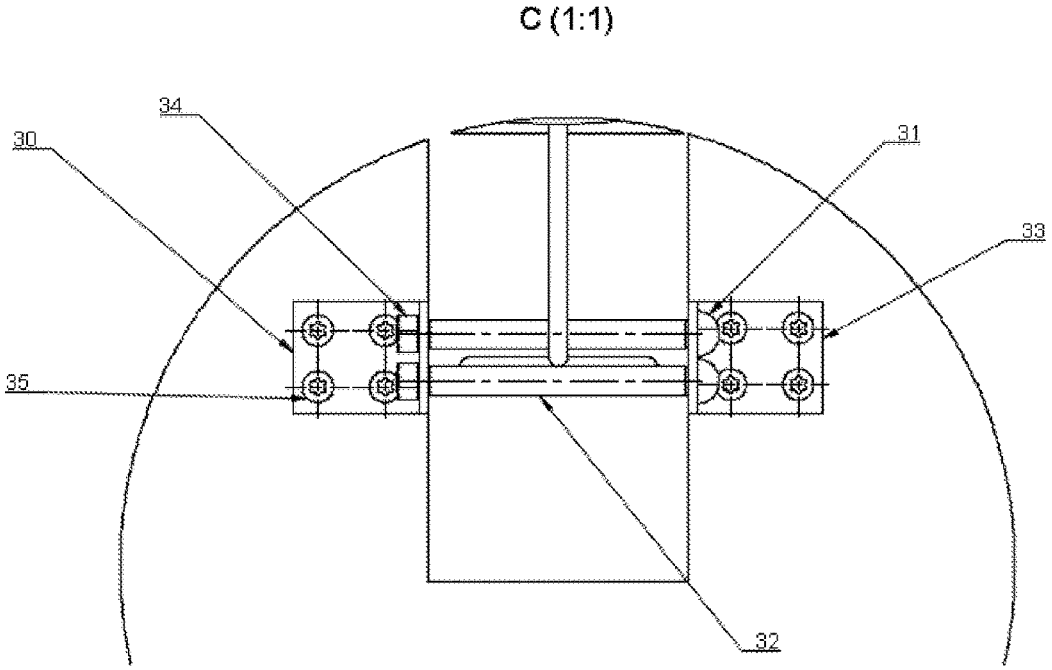

INERTIA TRAINING BOX WITH HORIZONTAL INERTIA WHEEL

FIELD OF THE INVENTION

The present invention relates to inertia training devices, which are often called flywheel training devices. Both terms inertia wheel and flywheel are used synonymously. More particularly, the invention relates to devices and machines using an inertia wheel as resistance unit in fitness machines for training muscles.

BACKGROUND

Inertia training has become increasingly popular over the last years, especially for professional athletes. Inertia training enables the athletes to train with eccentric overload which cannot be easily achieved with traditional gravity based weight training. Eccentric overload trains the user's muscles during the lengthening (eccentric) movement when the user stretches his legs for example, while most traditional gravity based weight training focus on training the user's muscles during the shortening (concentric) movement when the user bends his legs for example. Eccentric overload training has strong scientific support to increase total strength.

Current inertia training machines are expensive and relatively space consuming which does not make it affordable for many users.

Therefore, a need exists for a less expensive and space saving design to allow more persons to enjoy an eccentric overload training with an inertia wheel device. The present invention addresses these needs and provides an affordable and space saving design for inertia wheel training.

BRIEF SUMMARY OF THE INVENTION

A space saving and production cost saving inertia wheel training device is disclosed. In preferred embodiments the present invention comprises: a box where one or more inertia wheels are mounted horizontally; a pull belt which connects the inertia wheel with the user. The user stands with both feet on the box and can attach various accessories to the pull belt, like bars, harnesses, hip belt etc. to connect the pull belt to his body depending on the type of exercise the user wants to perform. The user adjusts the length of the belt to his body size. Then the user accelerates the inertia wheel. At the end of each movement of the user the flywheel needs to be decelerated or accelerated to allow the user to change the direction of his movement. The inertia of the wheel creates a braking force at deceleration and acceleration which leads to a training effect of the user's muscles.

BRIEF DESCRIPTION OF THE DRAWINGS

Some embodiments of the present invention are illustrated as an example and are not limited by the figures of the accompanying drawings, in which like references may indicate similar elements and in which:

FIG. 1. depicts a perspective view of an example of an inertia training box with horizontal inertia wheel according to various embodiments of the present invention.

FIG. 2. shows a front view of an example of an inertia training box with horizontal inertia wheel according to various embodiments of the present invention.

FIG. 3. illustrates a sectional, through line A-A shown in FIG. 2, side elevation view of an example of an inertia training box with horizontal inertia wheel according to various embodiments of the present invention.

FIG. 4. depicts a detailed view B as marked in FIG. 3, side elevation view of an example of an inertia training box with horizontal inertia wheel according to various embodiments of the present invention.

FIG. 5. illustrates a bottom view of an example of an inertia training box with horizontal inertia wheel according to various embodiments of the present invention.

FIG. 6. illustrates a detailed view C as marked in FIG. 5, bottom elevation view of an example of an inertia training box with horizontal inertia wheel according to various embodiments of the present invention.

DETAILED DESCRIPTION AND BEST MODE OF IMPLEMENTATION

The terminology used herein is for the purpose of describing particular embodiments only and is not intended to be limiting of the invention. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising", when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood, that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Novel inertia training devices are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as exemplification of the invention, and is not intended to limit the invention to the specific embodiments illustrated by the figures or description below.

The present invention will now be described by referencing the appended figures representing preferred embodiments.

FIG. 1. depicts a perspective view of an example of an inertia training box with horizontal inertia wheel assembly 999 (sometimes referred to as the "machine" or the "device"). In this preferred embodiment, the device 999 comprises a box 11 where an inertia wheel 12 is mounted horizontally; a pull belt 13 which connects the inertia wheel 12 with the user.

FIG. 4 shows the preferred embodiment of the connection between the inertia wheels 12, the box 11 and the pull belt 13. The inertia wheel 12 may be fixed on a shaft 14 with a washer 19 and nut 20. The shaft 14 and the inertia wheel 12 may have a square section which do not allow the inertia wheel 12 to turn on the shaft 14. The shaft 14 may be mounted with a bearing 15 and a bearing shell 16 with screws 17 to the box 11. A circlip 18 may fix the position of the bearing 15 on the shaft 14. The pull belt 13 may be fixed with a knot on the shaft 14.

The user stands on the box 11 and can attach various attachment parts to the hip belt, like bars, harnesses, belts etc. to connect the pull belt 13 to his body depending on the type of exercise the user wants to perform. The user adjusts the length of the pull belt 13 to his body size. The user has first to wind a section the pull belt 13 onto the shaft 14 by manually turning the inertia wheel 12. After that the user pulls on the pull belt 13 which accelerates the inertia wheel 12. When the pull belt 13 is fully unwound from the shaft 14 the inertia wheel 12 keeps turning due to its inertia. This again winds up the pull belt 13 onto the shaft which creates a pull force on the pull belt 13. This pull force while the user is not actively pulling is called an eccentric load while the user stretches his muscles. The user has to use his muscle power while stretching his muscles too to decelerate the inertia wheel 12 and to stop the pull belt 13 from continuing to wind onto to the shaft 14. When the inertia wheel 12 is stopped, the pull belt 13 is wound on the shaft 14 again and the user can start a new repetition by actively pulling the pull belt 13 and accelerate the inertia wheel 12 again.

The pull belt 13 may use a guiding unit 30 to be guided correctly to the user as shown in FIG. 6. The guiding unit 30 may consist of screws 31 with sleeves 32 which are fixed on sheet metal plates 33 with the help of nuts 34. The sheet metal plates may be attached with screws 35 to the box 11. As shown in FIG. 2 a connection piece 40 may be added to the pull belt 13 to better allow the user to connect accessories like hip belts, harnesses, bars etc. to the pull belt 13. The connection piece 40 may consists of a ring as shown in FIG. 2. The length of the pull belt 13 may be adjusted with sewed on hook and loop strips 22 as shown in FIG. 3.

In preferred embodiment the box 11 may consist of a frame 51 where a base plate 52 is attached with screws 53 as seen in FIG. 3. In preferred embodiment the frame 51 consist of steel and the base plate 52 consists of wood. Any other materials can be used to manufacture these or similar boxes and achieve similar results and as a result fall under scope of protection of this invention. In preferred embodiment a grip tape 54 is glued on top of the base plate 52 for better traction of the user's shoes.

In further preferred embodiments the connection piece 40 may consists of a carabiner. Alternatively the connection piece 40 may consists of a guide pulley assembly. In other preferred embodiments the connection piece 40 is not included at all and the pull belt 13 is directly attached to accessories like hip belts, harnesses, bars etc.

In other preferred embodiments the pull belt 13 may use eyelets and screws instead of hook and loop strips to adjust the length of the pull belt 13 to the user's body size.

In further preferred embodiments the pull belt 13 may be elongated and may be fixed on the box 11 in replacement of hook and loop strips or in combination with hook and loop strips. The fixation of the pull belt 13 on the box 11 may comprise of button which releases a spring and allows the adjustment of the pull belt 13 when the user presses the button. Any fixation and/or adjustment of the pull belt 13 onto the box 11 can achieve similar results and fall under the scope of protection of this invention.

In other preferred embodiments the inertia wheel 12 may not be perfectly horizontal and may be turned in any angle by maximum 45 degrees measured from the horizontal line. Mounting the inertia wheel 12 with maximum 45 degrees measured from the horizontal line results in comparable cost savings and space savings which as a result falls under scope of protection of this invention.

In other preferred embodiments instead of one inertia wheel 12 multiple inertia wheels 12 may be used to increase the inertia and as a result the resistance.

In other preferred embodiments the pull belt 13 may not be connected with a knot to the shaft 14. The pull belt may 13 may have a sewn loop which can be placed around the shaft 14 or the pull belt may 13 may be screwed onto the shaft 14 or the pull belt 13 may be clamped onto the shaft 14 or the pull belt may be fixed onto the shaft 14 with a pin.

While preferred materials for elements have been described, the device is not limited by these materials. Wood, plastics, rubber, foam, metal alloys, aluminum and other materials may comprise some or all of the elements of the leg exercise and movement device in various embodiments of the present invention.

The foregoing descriptions of specific embodiments of the present invention have been presented for purposes of illustration and description. They are not intended to be exhaustive or to limit the invention and method of use to the precise forms disclosed. It will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A training device comprising:

a box with a top configured to be stood on by a user, said top defines a horizontal surface;

a rotating shaft mounted in the box at an angle between 45 degrees to 90 degrees from the horizontal surface;

an inertia wheel mounted to the rotating shaft in the box and which rotates with the rotating shaft;

a pull belt attached to the rotating shaft and configured to be wound and unwound from the rotating shaft as the rotating shaft rotates;

wherein a portion of the inertia wheel protrudes from the box such that at least 10% of the inertia wheel volume is outside of the box so that the inertia wheel can be rotated by the user, causing the rotating shaft to rotate and the pull belt to be wound around the rotating shaft.

2. The training device of claim 1, further comprising a guiding unit to guide the pull belt to the user.

3. The training device of claim 1, wherein the pull belt has a round cross section.

4. The training device of claim 1, wherein the pull belt has a rectangular cross section.

5. The training device of claim 4, wherein hook and loop fasteners are provided at an end of the pull belt.

6. The training device of claim 1, wherein the height of the box is 6 inches or less.

7. The training device of claim 1, wherein the rotating shaft has a length of 8 inches or less.

* * * * *